United States Patent [19]

Pothast et al.

[11] Patent Number: 4,711,562

[45] Date of Patent: Dec. 8, 1987

[54] IMAGE-FORMING APPARATUS

[75] Inventors: Lambertus A. Pothast, Boxmeer; Johannes P. Grootentraast, Tegelen; Joannes F. J. Verdonschot, Nederweert, all of Netherlands

[73] Assignee: Oce-Nederland B.V., Venlo, Netherlands

[21] Appl. No.: 944,233

[22] Filed: Dec. 18, 1986

[30] Foreign Application Priority Data

Dec. 24, 1985 [NL] Netherlands ..... 8503559

[51] Int. Cl.[4] ..... G03G 15/00

[52] U.S. Cl. ..... 355/16; 355/3 BE; 355/14 R; 226/118

[58] Field of Search ..... 355/3 R, 3 BE, 14 R, 355/16; 226/118, 119

[56] References Cited

U.S. PATENT DOCUMENTS

| | | | |
|---|---|---|---|
| 3,155,022 | 11/1964 | Schwertz | 355/16 |
| 3,495,903 | 2/1970 | Morley et al. | 355/16 X |
| 4,046,473 | 9/1977 | Trainor | 355/16 |
| 4,183,658 | 1/1980 | Winthaegen | 355/16 X |
| 4,592,641 | 6/1986 | Roelofs et al. | 355/16 X |

*Primary Examiner*—Arthur T. Grimley
*Assistant Examiner*—J. Pendegrass
*Attorney, Agent, or Firm*—Reed Smith Shaw & McClay

[57] ABSTRACT

The present invention provides an apparatus for forming images on a substrate, using a belt-like medium which is moved past a number of precessing stations. The apparatus has at least two sections in which the belt-like medium can be driven at different speeds by different drive rollers at the same time. A buffer unit between the two sections compensates for the belt length shortage and/or surplus arising from the speed difference. The buffer unit consists of two parallel freely rotatable rollers secured to the ends of a rotatable frame.

5 Claims, 3 Drawing Figures

IMAGE-FORMING APPARATUS

FIELD OF THE INVENTION

The present invention relates to an imageforming apparatus utilizing a system for moving a photoreceptor belt at two different velocities at the same time.

BACKGROUND OF THE INVENTION

U.S. Pat. No. 4,046,473 discloses a photocopy apparatus using a flexible endless photoreceptor belt which has a shuttle mechanism located between the imaging and processing stations for simultaneously storing and dispensing portions of the belt to enable the belt to be stopped at the imaging station during imaging and then rapidly removed therefrom after imaging while the velocity of the belt at the processing station remains constant. In this apparatus, the shuttle mechanism includes two displaceable rollers that are interconnected by two mutually parallel connecting arms which can be displaced in the plane of the rollers in a direction perpendicular to the rollers. When the speed of the photoreceptor belt in the imaging station differs from that in the processing station, the displaceable roller system will move in the direction perpendicular to the rollers in order to compensate for the speed difference in the belt.

A disadvantage of this apparatus is that the displacement of the movable roller system requires a complex construction comprising linear guides, counterweights and springs. A construction of this kind is by its nature slack and, accordingly, skewing can readily occur in the connected rollers if the belt is not ideally flat and linear. Moreover, fouling of the linear guides may also result in obstruction to the movement of the movable roller system.

Other similar devices are shown in Xerox Disclosure Journal, Vol. 8, No. 1, (January/February 1983) at pp. 51–52 and U.S. Pat. No. 3,495,903. The device shown in the Xerox Disclosure uses a dual vacuum tensioning chamber to buffer and equalize the different velocities in the belt portions in the xerographic machine. However, the vacuum chamber system of this device will show problems of excessive wear of the belt surface sliding over the chamber walls and of vibrations caused by eddies of air leaking into the chamber at the sides of the belt.

The device shown in U.S. Pat. No. 3,495,903 shows a way of changing web speed in one part of a device while maintaining a constant speed in the other part by moving the web rollers at the exposure station in a direction opposite to the motion of the web. In this device, the web itself is not driven at a different speed and thus control of the resulting speed differential is difficult because it involves controlling two different motions, i.e. the motion of the web and the displacement of the rollers. As a result, a very complicated mechanism that needs careful adjustment and that may wear easily is used to control the two different motions.

The present invention provides an image-forming apparatus without these disadvantages.

SUMMARY OF THE INVENTION

Generally, the present invention provides an image-forming apparatus including a belt-like medium on which an image can be formed; at least two processing stations for forming the image on the medium; a first system for conveying the medium part a first processing station, the first system having a plurality of mutually parallel, freely rotatable rollers and a drive device for driving the medium at a first constant speed; at least a second system for conveying the medium past a second processing station, the second system having a plurality of mutually parallel, freely rotatable rollers and a drive device for driving the medium at a second speed which at least temporarily differs from the first speed; and wherein two rollers of the second system, one of which is situated in front of and one after the second processing station when considered in the direction of medium movement, are interconnected and are secured to a rotatable lever mechanism, the axis of rotation of which is parallel to and equidistant from the two rollers and is situated in the plane defined by the two rollers.

The movement of the two rollers, therefore, is obtained with a simpler construction, which in addition is sufficiently stiff, is practically frictionless, has a small mass and requires no extra maintenance. In a preferred embodiment of the present invention, the center line of the lever mechanism is situated in the plane defined by the two rollers.

Other features and advantages of the invention will become apparent from the following detailed description and the accompanying drawings of a presently preferred embodiment of the best mode of carrying out the invention.

DESCRIPTION OF THE PREFERRED EMBODIMENT

Figure 1:
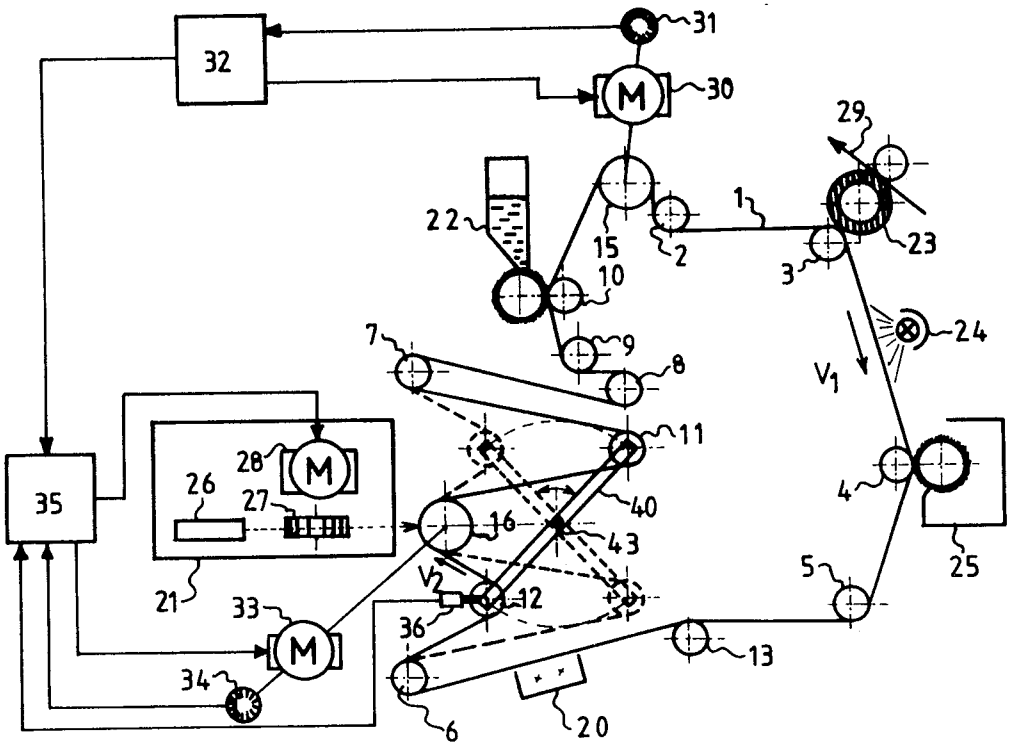
FIG. 1 is a diagrammatic section of an apparatus according to the present invention.

FIG. 1 shows an embodiment of the apparatus according to the present invention used in an electrophotographic laser printer. A belt 1 having a layer of photoconductive material thereon is taken over a number of rollers 2, 3, 4, 5, 13, 6, 16, 7, 8, 9, 10 and 15 rotatably supported by a frame (not shown), and rollers 11 and 12 rotatably supported in a movable mechanism 60 which is described hereinafter. Belt 1 can move past a number of processing stations, such as a charging station 20, an exposure station 21, a developing station 22, an image transfer station 23, an integral exposure station 24 and a cleaning station 25.

Figure 2:
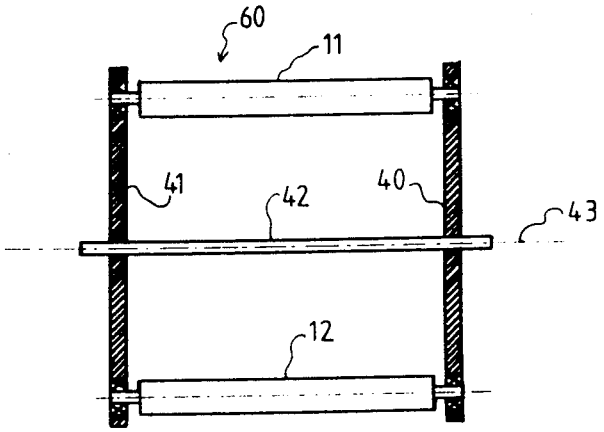
FIG. 2 shows the movable roller system of FIG. 1.

As shown in FIG. 2, rollers 11 and 12 are mounted, freely rotatable, in the respective ends of two mutually parallel arms 40 and 41. Arms 40 and 41 are secured to a shaft 42 rotatably mounted in a frame (not shown) such that center line 43 of shaft 42 is equidistant from rollers 11 and 12.

Roller 15 is driven by motor 30. The speed of motor 30 is controlled by a control unit 32 by means of a pulse generator 31. Roller 16 is driven by motor 33. The speed of motor 33 can be controlled by a control unit 35 by means of a pulse generator 34. Exposure station 21 consists of a laser 26 and a rotatable polygonal mirror 27 driven by motor 28. The speed of motor 28 is also controlled by control unit 35.

To make a print, the photoconductive layer on belt 1 is first provided with a homogeneous surface charge in charging station 20 and then exposed imagewise in exposure station 21 where the laser beam is continually moved afresh over moving belt 1 by rotating polygonal mirror 27. By switching laser 26 on and off rapidly, a light pattern is built up on belt 1 corresponding to the required image.

Where light strikes belt 1, the surface charge flows off so that the remaining charge pattern corresponds to the required image. This charge pattern is developed in a known manner with black powder in developing station 22 and the resulting powder image is then transferred in transfer station 23 to a receiving material 29, and is fixed thereon to give the required print.

Photoconductive belt 1 is then integrally exposed in station 24 and the remaining powder is removed in cleaning station 25, whereafter belt 1 is ready for the next print cycle. The aforementioned operations are sufficiently known from the literature and therefore require no further explanation here. Also, the processing stations, except for the exposure station, permit one to have high belt speed without reducing the quality of their operation.

Phenomena arising during the switching on and off of different stations makes it necessary to have some intermediate space between the imaging sections (i.e. the belt zones on which an image is formed). The presence of these intermediate spaces enables belt 1 to be moved at a high speed $V_1$ in part of the apparatus and at a lower speed $V_2$ at exposure station 21. To compensate for the belt speed difference, a movable roller system 60 is used formed by rollers 11 and 12 and a rotatable lever mechanism including 40, 41 and 42. The operation of this roller system will be explained in the following description.

In the inoperative position, the rotatable lever mechanism and rollers 11 and 12, are in the position indicated by the solid lines in FIG. 1. In this condition, the bottom end of arms 40 and 41 near roller 12 rests against an abutment 36 which is provided with a switch. When belt 1 moves but no print is being made, motor 33 of drive roller 16 is controlled to a constant torque sufficient to hold movable roller system 60 in the solid line position but not sufficient to accelerate belt 1. Belt 1 is, therefore, driven by motor 30 by means of drive roller 15.

When the print cycle is started, photoconductive belt 1 is provided with a uniform surface charge by charging unit 20 and when the charged area of belt 1 reaches exposure station 21, control unit 32 delivers a start signal to separate control unit 35. Control unit 35 now takes over control of belt 1 in exposure station 21 by accurately controlling motor 33 which drives drive roller 16. The control is provided by means of pulse generator 34 which is fixed on the shaft of motor 33. This control system is linked to the speed control of polygonal mirror 27 in order to avoid any image distortion. The belt speed in exposure station 21, i.e. the speed of drive roller 16, is now reduced to a speed $V_2$ suitable for the exposure unit.

By means of the pulses from pulse generator 34, control unit 35 continually determines the position of belt 1. When the charged part of the belt has arrived in the exposure zone, control unit 35 delivers to exposure station 21 a command to start the imagewise exposure. The system inertia is taken into account so that the start command is not given until the belt speed is constant.

The difference between the belt speed in exposure station 21 and the belt speed in the rest of the apparatus means that there will be a shortage of belt length between rollers 16 and 7 and an equal surplus of belt length between rollers 6 and 16. Consequently, the rotatable lever mechanism and rollers 11 and 12 will move toward and into the position indicated by the broken lines in FIG. 1 by pivoting or rotating about shaft 42. It should be noted that this movement is completely passive and that the belt tension required to obviate slip over drive rollers 16 and 15 does not change appreciably. The passive character of movable roller system 60 offers the possibility of short-circuiting vibrations in the belt movement in the first system so that they are not perceptible in the second system. This is a result of the relatively small mass and frictionless movement of the rotatable lever mechanism including rollers 11 and 12 and the relatively large mass of drive-roller 16. The exposed part of belt 1 leaves exposure station 21 and continues on its way from roller 11 to the subsequent processing stations at the normal apparatus speed $V_1$.

Movable roller system 60 is so designed that exposure station 21 has completed its task when the rotatable lever mechanism just reaches its maximum displacement which is indicated by the broken lines in FIG. 1. Before a new part of belt 1 can be exposed, movable roller system 60 must be returned to the inoperative position. This can be done in the time which elapses when an intermediate space between two imaging sections (as described hereinbefore) passes exposure station 21. To this end, control unit 35 raises the speed of motor 33, and hence of drive roller 16, to a value $V_3$ which is higher than the normal apparatus speed $V_1$ so that movable mechanism 60 including rollers 11 and 12 will automatically and passively return to the inoperative position. When the switch in abutment 36 is energized, this is the signal to control unit 35 that its task is done and it will again control motor 33 to a constant torque so that the belt speed in the whole apparatus becomes equal to $V_1$.

Figure 3:
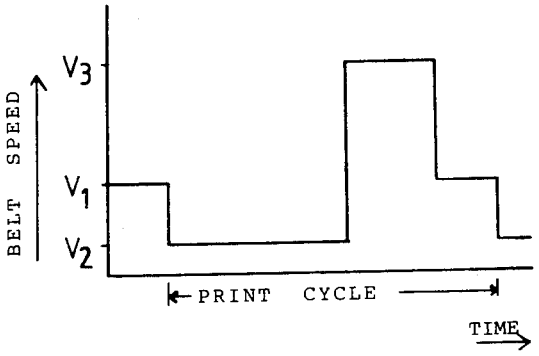
FIG. 3 is a graphical representation of the belt speed in the second system.

FIG. 3 graphically shows the belt speed at drive roller 16 in exposure station 21 at various times in the cycle. In practice, however, the speed changes will be less abrupt than indicated.

Although the present invention has been explained with reference to a laser printer, the invention is of course not restricted thereto. In principle, the roller system described herein can also be used for other processing stations if they operate significantly more inertly than the other stations. With the converse operation of the roller system, the processing station can of course also operate faster than the other stations.

While presently preferred embodiments of the invention have been shown and described with particularity, the invention may be otherwise embodied within the scope of the appended claims.

What is claimed is:

1. An image-forming apparatus comprising:

(a) a belt-like medium on which an image can be formed;

(b) a plurality of processing stations for forming the image on the medium;

(c) a first system for conveying the medium past a first processing station, the first system having a plurality of mutually parallel, freely rotatable rollers and a drive device for driving the medium at a first constant speed;

(d) at least a second system for conveying the medium past a second processing station, the second system having a plurality of mutually parallel, freely rotatable rollers and a drive device for driving the medium at a second speed which at least temporarily differs from the first speed; and (e) wherein two rollers of the second system, one of which is situated in front of and one after the second processing station when considered in the direction of medium movement, are interconnected and are secured to a rotatable lever mechanism, the axis of rotation of which is parallel to and equidistant from the two rollers and is situated in the plane defined by the two rollers.

2. An apparatus as described in claim 1 wherein the speed of the belt-like medium in the second system is controlled during a portion of a cycle as a function of the operation of the second processing station and during the rest of the cycle is determined by the speed of the medium in the first system.

3. An apparatus as described in claim 1 wherein the first processing station situated in the first system is switched on and off as a function of the movement of the medium in the first system and the second processing station situated in the second system is switched on and off as a function of the movement of the medium in the second system.

4. An apparatus as described in claim 2 wherein the first processing station situated in the first system is switched on and off as a function of the movement of the medium in the first system and the second processing station situated in the second system is switched on and off as a function of the movement of the medium in the second system.

5. In an image-forming apparatus having a belt-like medium on which an image can be formed; at least two processing stations for forming an image on the medium; a first system for conveying the medium past at least a first processing station, the first system having a plurality of parallel, freely rotatable rollers and a drive device for driving the medium at a first constant speed; a second system for conveying the medium past a second processing station, the second system having a plurality of mutually parallel freely rotatable rollers and a drive device for driving the medium at a second speed which at least temporarily differs from the first speed, the improvement comprising two rollers of the second system, one of which is situated in front of and one after the second processing station when considered in the direction of medium movement, are interconnected and are secured to a rotatable lever mechanism having an axis of rotation which is parallel to and equidistant from the two rollers and is situated in the plane defined by the two rollers.

* * * * *

UNITED STATES PATENT AND TRADEMARK OFFICE

CERTIFICATE OF CORRECTION

PATENT NO. : 4,711,562

DATED : December 8, 1987

INVENTOR(S) : Pothast et al.

It is certified that error appears in the above-identified patent and that said Letters Patent is hereby corrected as shown below:

In the Abstract, line 3: please delete --precessing-- and insert "processing" therefor.

Column 1, line 3: please delete --imageforming-- and insert "image-forming" therefor.

Column 1, line 67: please delete --part-- and insert "past" therefor.

Signed and Sealed this

Ninth Day of August, 1988

*Attest:*

*Attesting Officer*

DONALD J. QUIGG

*Commissioner of Patents and Trademarks*